US009725990B2

(12) United States Patent
Johnson et al.

(10) Patent No.: US 9,725,990 B2
(45) Date of Patent: Aug. 8, 2017

(54) MULTI-LAYERED WELLBORE COMPLETION FOR METHANE HYDRATE PRODUCTION

(71) Applicant: BAKER HUGHES INCORPORATED, Houston, TX (US)

(72) Inventors: Michael H. Johnson, Katy, TX (US); Mark K. Adam, Houston, TX (US); Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 289 days.

(21) Appl. No.: 14/447,009

(22) Filed: Jul. 30, 2014

(65) Prior Publication Data

US 2015/0068760 A1 Mar. 12, 2015

Related U.S. Application Data

(63) Continuation-in-part of application No. 14/023,982, filed on Sep. 11, 2013, now Pat. No. 9,097,108.

(51) Int. Cl.
*E21B 43/12* (2006.01)
*E21B 43/08* (2006.01)

(52) U.S. Cl.
CPC ..... *E21B 43/082* (2013.01)

(58) Field of Classification Search
CPC ..... E21B 43/12; E21B 43/122; E21B 43/108; E21B 43/08
USPC ..... 166/276, 278
See application file for complete search history.

(56) References Cited

U.S. PATENT DOCUMENTS

| | | | |
|---|---|---|---|
| 6,148,911 | A | 11/2000 | Gipson et al. |
| 7,413,022 | B2 | 8/2008 | Broome et al. |
| 7,578,343 | B2 | 8/2009 | Augustine |
| 7,743,835 | B2 | 6/2010 | Willauer |
| 7,832,490 | B2 | 11/2010 | Willauer |
| 7,921,915 | B2 | 4/2011 | Richard et al. |
| 7,926,565 | B2 | 4/2011 | Duan et al. |
| 7,954,546 | B2 | 6/2011 | Kim et al. |
| 8,048,348 | B2 | 11/2011 | Duan et al. |
| 8,225,863 | B2 | 7/2012 | Hammer et al. |

(Continued)

FOREIGN PATENT DOCUMENTS

| | | | |
|---|---|---|---|
| WO | 2008151311 | A2 | 12/2008 |
| WO | 2010045077 | A2 | 4/2010 |

(Continued)

*Primary Examiner* — Silvana Runyan
(74) *Attorney, Agent, or Firm* — Steve Rosenblatt

(57) ABSTRACT

In a completion for producing methane the bottom hole assembly has a base pipe with porous media surrounding it for equalizing flow along the base pipe. A shape memory polymer foam surrounds the porous media. The borehole can be reamed to reduce produced methane velocities. Surrounding the shape memory polymer is an exterior layer of consolidated proppant or sand that can self-adhere and/or stick to the polymer foam. The proppant or sand can be circulated or squeezed into position although, circulation is preferred. The borehole may enlarge due to shifting sands in an unconsolidated formation as the methane is produced. The bottom hole assembly helps in fluid flow equalization and protects the foam and layers below from high fluid velocities during production.

11 Claims, 2 Drawing Sheets

(56) References Cited

U.S. PATENT DOCUMENTS

| | | | | |
|---|---|---|---|---|
| 8,353,346 | B2 | 1/2013 | Johnson | |
| 2003/0075333 | A1 | 4/2003 | Vercaemer et al. | |
| 2004/0104052 | A1 | 6/2004 | Livingstone | |
| 2004/0177961 | A1 | 9/2004 | Nguyen | |
| 2004/0261994 | A1 | 12/2004 | Nguyen et al. | |
| 2007/0144741 | A1 | 6/2007 | Cho et al. | |
| 2007/0227731 | A1* | 10/2007 | Contant | E21B 34/06 166/278 |
| 2008/0072495 | A1* | 3/2008 | Waycuilis | B01D 53/14 48/190 |
| 2008/0296020 | A1 | 12/2008 | Willauer | |
| 2008/0296023 | A1 | 12/2008 | Willauer | |
| 2009/0032244 | A1 | 2/2009 | Zupanick | |
| 2009/0078419 | A1* | 3/2009 | Dusterhoft | C09K 8/50 166/295 |
| 2009/0101353 | A1 | 4/2009 | Crow et al. | |
| 2009/0178805 | A1 | 7/2009 | Yemington | |
| 2010/0077594 | A1 | 4/2010 | Richard | |
| 2010/0089565 | A1 | 4/2010 | Duan et al. | |
| 2010/0294513 | A1 | 11/2010 | Van Nieuwkoop | |
| 2011/0067872 | A1 | 3/2011 | Agrawal | |
| 2011/0073296 | A1 | 3/2011 | Richard et al. | |
| 2011/0162780 | A1 | 7/2011 | Duan et al. | |
| 2011/0232901 | A1 | 9/2011 | Carrejo et al. | |
| 2011/0252781 | A1 | 10/2011 | Johnson | |
| 2011/0259587 | A1 | 10/2011 | Joseph et al. | |
| 2012/0145389 | A1 | 6/2012 | Fitzpatrick, Jr. | |
| 2012/0181017 | A1 | 7/2012 | Hart et al. | |
| 2012/0247761 | A1 | 10/2012 | O'Malley | |
| 2013/0062067 | A1 | 3/2013 | Guest et al. | |
| 2013/0068481 | A1* | 3/2013 | Zhou | E21B 43/10 166/381 |
| 2013/0090854 | A1 | 4/2013 | Rasmus et al. | |
| 2013/0126170 | A1 | 5/2013 | Johnson et al. | |
| 2013/0206406 | A1 | 8/2013 | Kuo et al. | |

FOREIGN PATENT DOCUMENTS

| | | | |
|---|---|---|---|
| WO | 2011037950 | A2 | 3/2011 |
| WO | 2011133319 | A2 | 10/2011 |
| WO | 2011162895 | A2 | 12/2011 |

* cited by examiner

MULTI-LAYERED WELLBORE COMPLETION FOR METHANE HYDRATE PRODUCTION

CROSS REFERENCE TO RELATED APPLICATION

This application is a continuation-in-part of U.S. Pat. No. 9,097,108 B2, for "Wellbore Completion for Methane Hydrate Production", filed on Sep. 11, 2013, and claims the benefit of priority from the aforementioned application.

FIELD OF THE INVENTION

The field of this invention is completions and more particularly in unconsolidated formations that produce methane hydrate where there is a need for sand control and flow distribution to protect the screen while stabilizing the borehole.

BACKGROUND OF THE INVENTION

Methane hydrate exists as a solid substance in layers that contain sand and other sediment. Hydrate to methane gas and water must be accomplished in order to produce the methane gas. The production of methane hydrate means dissociating methane hydrate in the layers and collecting the resultant methane gas through wells and production systems. To dissociate methane hydrate that is stable at low temperature and under high pressure, there must be an (1) increase the temperature, (2) decrease the pressure, (3) or both. The optimum methane hydrate production method is one based on the "depressurization method." However, since methane hydrate layers are unconsolidated sediments, sand production occurs with the methane gas and water. Because removal of the methane, water, and sand, wellbore stability becomes an issue that cannot be overcome with conventional sand control methodologies. Economical and effective measures for preventing sand production and solving borehole stability issues require a novel approach to completion methodology.

The proposed method to control sand production and provide better borehole stability comprises providing a shape memory polymer foam filter that does not depend on the borehole for containment for sand management. The shape memory polymer will be utilized such that a flow path would not be exposed that would permit the production of sand from the borehole. One other issue related to the depressurization method of methane hydrate production is the uniform application of a differential pressure across the reservoir interface. The method further comprises a porous media under the shaped memory polymer foam filter that can be varied in number and permeability to balance the differential pressure applied to the reservoir being produced. This improves borehole stability via uniform drawdown and flow from the exposed reservoir. While these techniques could be used in a conventional open hole or cased hole completion, it is desirable to under ream or expand the borehole size to help increase wellbore radius and decrease flow velocities at the sand management/reservoir interface. Additionally, consolidated proppant or sand could be deposited adjacent the shape memory foam as it is not the objective to fully occupy the borehole with the foam after it crosses its critical temperature. Instead, in recognition that the hole can be enlarged with initial reaming to reduce fluid velocities or alternatively additional methane production destabilizes the formation and can enlarge the borehole, the consolidated proppant or sand can be an outer protective layer to the foam. Its ability to self-adhere contains the foam and protects the foam from erosive velocity effects of the produced methane.

Several references that employ memory foam in sand control applications are as follows:

WO/2011/162895A;
U.S. Pat. No. 8,353,346
US20110252781
WO/2011/133319A2
US20130062067
WO/2013/036446A1
US20130126170
U.S. Pat. No. 8,048,348
US20100089565
US20110162780
U.S. Pat. No. 7,926,565
WO/2010/045077A2
US20110067872
WO/2011/037950A2
U.S. Pat. No. 7,832,490
US20080296023
US20080296020
U.S. Pat. No. 7,743,835
WO/2008/151311A3

Flow balancing devices are generally discussed in the following references:

U.S. Pat. No. 7,954,546
U.S. Pat. No. 7,578,343
U.S. Pat. No. 8,225,863
U.S. Pat. No. 7,413,022
U.S. Pat. No. 7,921,915

A need exists for an assembly and method of producing methane from an unconsolidated formation surrounding a borehole having methane hydrate, sand or other sediments. Once positioned and set near the formation, the filtration assembly should be able to manage sand and other sediments without having to rely on the geometric configuration of the borehole for containment, such that should the surrounding borehole subsequently enlarge or the space between the formation and the assembly increase due to changing reservoir conditions the geometric configuration of the assembly will not substantially change.

Those skilled in the art will better appreciate additional aspects of the invention from a review of the detailed description of the preferred embodiment and the associated drawings while appreciating that the full scope of the invention is to be determined by the appended claims.

SUMMARY OF THE INVENTION

In a completion for producing methane the bottom hole assembly has a base pipe with porous media within it for equalizing flow along the base pipe. A shape memory polymer foam surrounds the base pipe with porous media. The borehole can be reamed to reduce produced methane velocities. Surrounding the shape memory polymer is an exterior layer of consolidated proppant or sand that can self-adhere and/or stick to the polymer foam. The proppant or sand can be circulated or squeezed into position although, circulation is preferred. The borehole may enlarge due to shifting sands in an unconsolidated formation as the methane is produced. The bottom hole assembly helps in fluid flow equalization and protects the foam and layers below from high fluid velocities during production.

DETAILED DESCRIPTION OF THE PREFERRED EMBODIMENT

Figure 1:
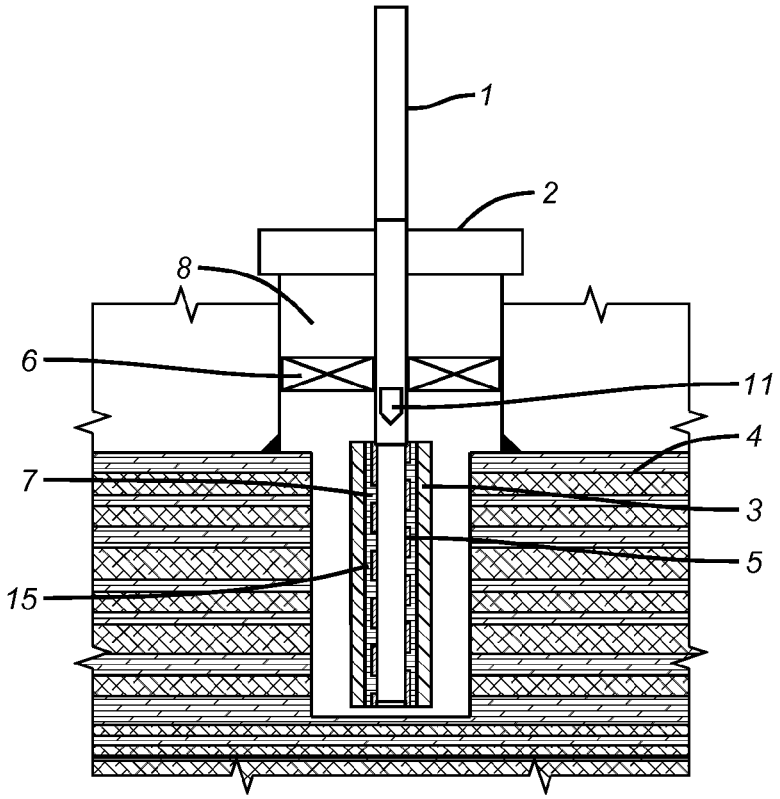
FIG. 1 shows the run in position of the bottom hole assembly with the shape memory polymer foam as yet unexpanded.

In broad terms the preferred embodiment can be described as a filtration assembly and method of producing methane from methane hydrate in an unconsolidated formation containing sand and other sediments. The filtration assembly comprises a bottom hole assembly comprising a sand control assembly and a base pipe. The sand control assembly comprises a shape memory porous material, which is adapted to surround the base pipe and form a first discrete filtration layer. In one embodiment, to assist in filtering sand and other sediments from the methane a second discrete filtration layer is placed over the first discrete filtration layer comprising consolidated proppant, gravel or sand, or any combination thereof, that can adhere either to each other, the first discrete filtration layer, or both, and remain adhered should reservoir conditions change. The second discrete filtration layer may be circulated or squeezed into position after the bottom hole assembly has been positioned near the formation, or run in as part of the bottom hole assembly, although circulation is preferred. In an alternative embodiment, the third discrete filtration layer is located under the first discrete filtration layer and comprises one or more filtration assurance devices adapted to support the first discrete filtration layer, assist in filtering sediment from the methane, or aid in depressurization of the formation, or any combination thereof, such as wire mesh, prepack screen or beadpack.

In a preferred embodiment, the shape memory porous material is an open-cell shape memory foam, such as the foam described in the list of memory foam patents and patent applications referenced above, and the memory foam marketed by Baker Hughes Incorporated under the trademark GEOFORM™. The memory foam is adapted to help manage sand production by inhibiting the formation of a flow path through the filtration layer in which sand may be produced and by providing borehole stability without having to depend on containment by the surrounding borehole.

To dissociate methane from methane hydrate, a depressurization method is employed by applying a differential pressure across the reservoir interface between the bottom hole assembly and the formation, using, for example, an electric submersible pump. As the methane dissociates from methane hydrate it passes through the filtration assembly, which filters sand and other sediments from the methane and allows the methane to enter the base pipe. In one embodiment, the base pipe comprises a depressurization device designed to help equalize flow along at least one interval of the base pipe and protect the filtration layers from high fluid velocities during production. As previously mentioned, however, the third discrete filtration layer when located under the first discrete filtration layer may also serve as a means of assisting in the depressurization of the formation. The borehole may also be reamed to reduce methane production velocities.

When the borehole subsequently enlarges or the space between the formation and the bottom hole assembly increases due to changing reservoir conditions (e.g., shifting of sands or other sediments in an unconsolidated formation as the methane is produced) the geometric configuration of the bottom hole assembly will not substantially change.

Referring to FIG. 1 a work string 1 is run through a wellhead 2. The bottom hole assembly comprises a base pipe 5 with openings. A production packer 6 isolates the methane hydrate reservoir 4. A schematically illustrated crossover tool 11 allows placement of the consolidated proppant or sand (gravel) 9 about the shape memory polymer foam 3. See FIG. 3. In one embodiment, the base pipe 5 has depressurization devices 7, such as an annularly shaped porous member of different thicknesses and porosities, or a housing having one or more tortuous paths of different resistances to fluid flow, adapted to help equalize flow along at least one interval of the base pipe and help protect the filtration layers from high fluid velocities during production such as a choke valve, bead pack, prepack screen or wire mesh 15.

In one embodiment, the base pipe comprises a depressurization device for balancing flow along at least one interval of the base pipe, or a selectively or automatically adjustable inflow control member (e.g., an adjustable valve or tubular housing having one or more inflow passages, preferably with a tortuous pathway). See for example, U.S. Pat. Pub. No. 2013/0180724 and flow control products marketed by Baker Hughes Incorporated (United States of America) under the trademark EQUALIZER™.

Figure 2:
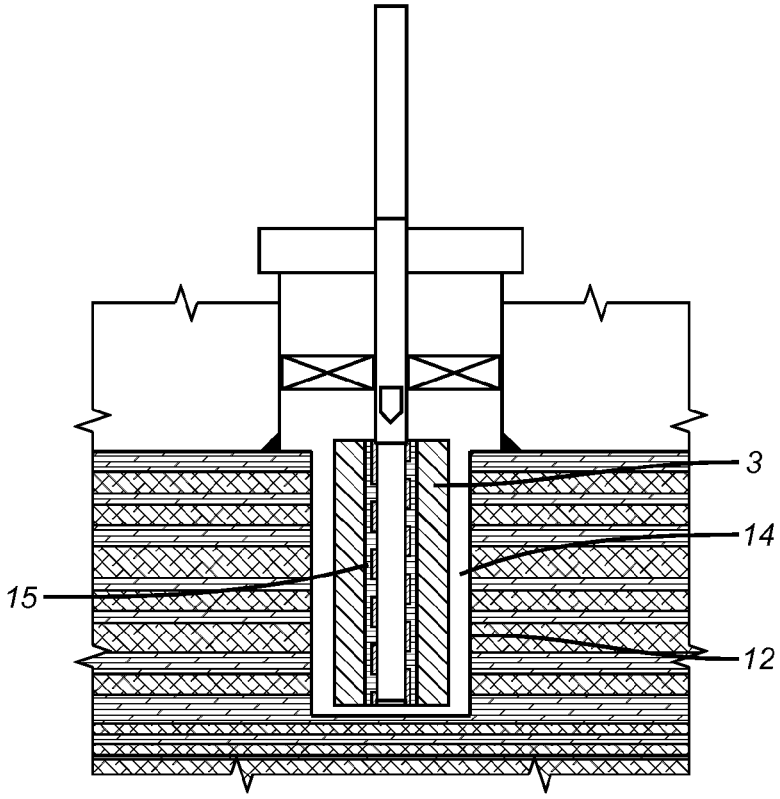
FIG. 2 is the view of FIG. 1 with the polymer foam expanded.
Figure 3:
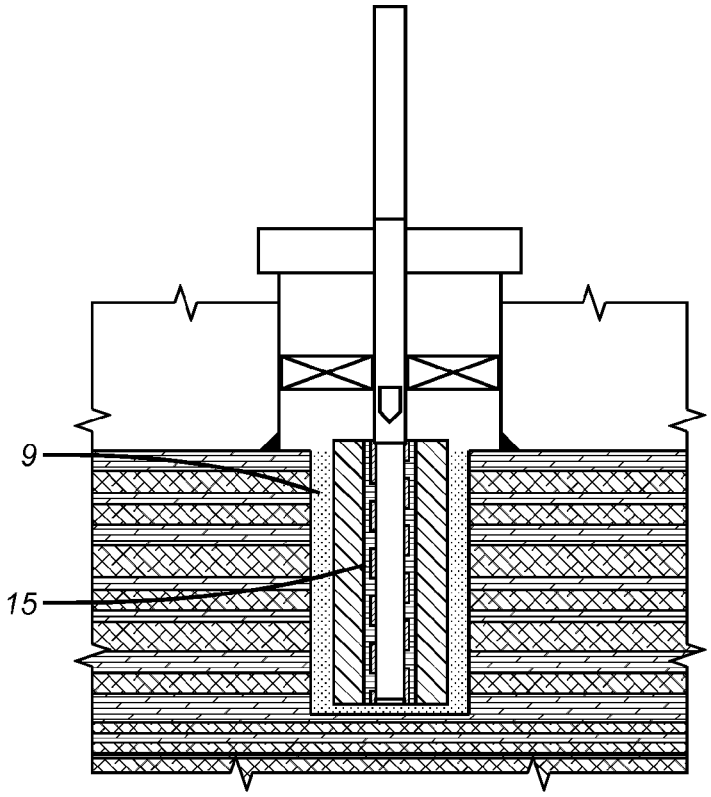
FIG. 3 is the view of FIG. 2 with the consolidated proppant or gravel in position.
Figure 4:
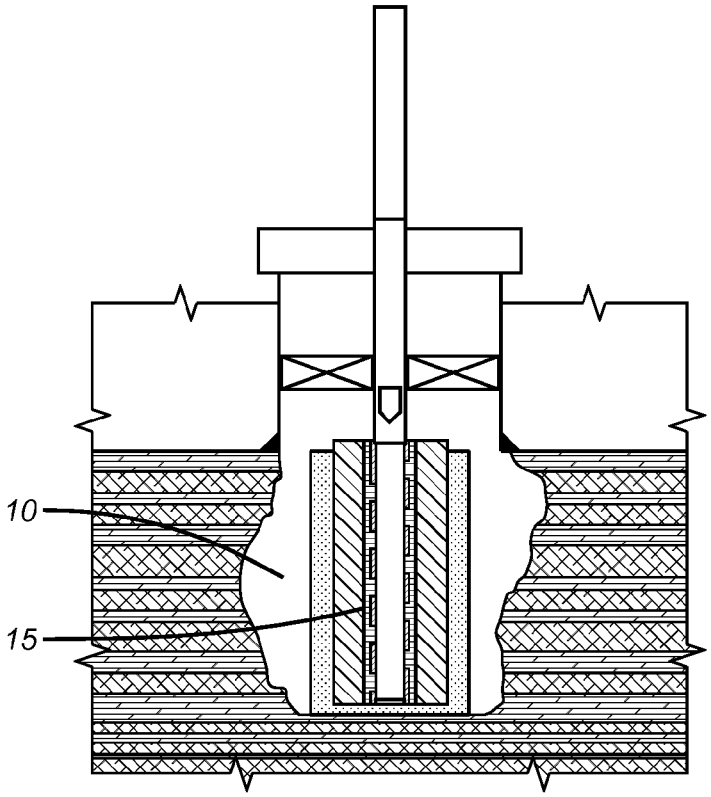
FIG. 4 is the view of FIG. 3 showing the shifting of the unconsolidated borehole wall during methane production.

In FIG. 1 the memory polymer foam 3 is in its run in dimension where it has not yet been warmed above its transition temperature. In FIG. 2 the transition temperature has been reached and the polymer foam 3 has expanded to a location still short of the borehole wall 12 to leave an annular gap 14 into which the proppant or sand 9 will be deposited using the crossover 11 as illustrated in FIG. 3. This is done preferably with circulation with crossover 11 and using a wash pipe that is not shown to direct returns that come through the proppant/sand 9 and the memory foam 3 into the upper annulus 8 above the packer 6. Finally, FIG. 4 illustrates the onset of methane production that ensues when the pressure in the formation 4 is allowed to be reduced. With the removal of methane a large void volume 10 can be created. This has the beneficial effect of reduction of fluid velocities for the methane. Those skilled in the art will appreciate that the initial deposition of the proppant or sand 9 could likely fill the remaining annular space around the memory foam 3 by virtue of the addition of the proppant or sand 9 until some pressure resistance is sensed at the surface indicating that the volume in the annulus has packed in. The delivery of the proppant or sand 9 can begin before, during or after the foam 3 reaches its critical temperature and grows dimensionally. In any of those cases the production of methane can hollow out the reservoir as shown in FIG. 4 so the adherence of the proppant or sand 9 to itself and to the foam helps to keep the components within the foam 3 protected from erosive high gas velocities. The enlarging of the borehole as well as the flow balancing devices 7 also helps to control high velocity gas erosion to keep the bottom hole assembly serviceable for a longer time before a workover is needed.

The combination of flow balancing with the self-adhering proppant or sand 9 covering the memory polymer foam 3 and to some extent adhering to the foam allows for a longer service life as the layers of filtration remain serviceable longer in adverse conditions such as borehole collapse and potential for erosion caused at least in part by flow imbalance induced high gas velocities.

The proppant/sand 9 can be a commercially available product such as Sandtrol®. The foam is available as Geo-FORM®. Alternatives can be alloy memory foam or screens of various designs that do not change dimension with thermal stimulus. The screens can be constructed so that they can be radially expanded for borehole support or to reduce the volume needed for the proppant/sand 9. The flow balancing feature can be a porous annular shape or insert plugs in the base pipe or screen materials that vary in mesh size at different opening locations.

The above description is illustrative of the preferred embodiment and many modifications may be made by those skilled in the art without departing from the invention whose scope is to be determined from the literal and equivalent scope of the claims below:

We claim:

1. A method of creating an artificial reservoir to allow for production of methane from an unconsolidated wellbore formation surrounding an open hole borehole comprising methane hydrate, sand or other sediments, said method comprising:

delivering a consolidated artificial barrier to the open hole borehole near the unconsolidated wellbore formation using a bottom hole assembly; wherein the artificial barrier is adapted to reduce erosion of the surrounding formation by equalizing through the use of depressurization devices the disassociation of methane hydrate across an interval of the bottom hole assembly while not stressing the surrounding formation;

using a shape memory porous member whose dimension increases radially in the open hole borehole and at least one of a porous media and consolidated proppant in said artificial barrier; and enlarging the artificial barrier to leave an annular gap to the open hole that remains during subsequent methane production;

producing methane.

2. The method of claim 1, comprising:

said artificial barrier has multiple layers at least one of which are delivered with or after the delivery of said bottom hole assembly.

3. The method of claim 1, comprising:

using a prepack screen in said artificial barrier.

4. The method of claim 1, comprising:

allowing said shape memory porous member to enlarge while leaving room in the borehole for delivery of consolidated proppant.

5. The method of claim 1, comprising:

reaming the borehole before or during delivery of said bottom hole assembly.

6. The method of claim 1, comprising:

using said consolidated proppant to protect other layers of said artificial barrier from erosion from velocity effects of producing methane.

7. The method of claim 1, comprising:

balancing flow through a plurality of base pipe openings in said bottom hole assembly.

8. The method of claim 1, comprising:

adhering said consolidated proppant to itself or to said shape memory porous member.

9. The method of claim 1, comprising:

putting a wire screen, prepack screen or bead pack under said shape memory porous member and covering said shape memory porous member with said consolidated proppant.

10. The method of claim 1, comprising:

maintaining the size of said artificial barrier despite hole enlargement caused by production of methane.

11. The method of claim 1, comprising:

using foam for said porous shape memory barrier.

* * * * *